US009975667B2

(12) United States Patent
Bardet

(10) Patent No.: US 9,975,667 B2
(45) Date of Patent: May 22, 2018

(54) CLOSURE

(75) Inventor: Philippe Bardet, Gleize (FR)

(73) Assignee: Obrist Closures Switzerland GmbH, Reinach (CH)

( * ) Notice: Subject to any disclaimer, the term of this patent is extended or adjusted under 35 U.S.C. 154(b) by 0 days. days.

(21) Appl. No.: 13/824,963

(22) PCT Filed: May 14, 2012

(86) PCT No.: PCT/GB2012/000427

§ 371 (c)(1),
(2), (4) Date: Mar. 18, 2013

(87) PCT Pub. No.: WO2012/160325

PCT Pub. Date: Nov. 29, 2012

(65) Prior Publication Data

US 2013/0180942 A1 Jul. 18, 2013

(30) Foreign Application Priority Data

May 23, 2011 (GB) ..... 1108656.8

(51) Int. Cl.
*B65D 43/00* (2006.01)
*B65D 43/02* (2006.01)
*B65D 41/04* (2006.01)

(52) U.S. Cl.
CPC ..... *B65D 43/02* (2013.01); *B65D 41/0471* (2013.01); *B65D 2251/04* (2013.01)

(58) Field of Classification Search
CPC ..... B65D 41/0471; B65D 41/0478; B65D 41/0485; B65D 2251/04; B65D 41/0457; B65D 41/04
USPC ..... 215/252, 218, 216, 267, 320, 321, 296, 215/529, 330, 331, 333, 222
See application file for complete search history.

(56) References Cited

U.S. PATENT DOCUMENTS

| | | | | | |
|---|---|---|---|---|---|
| 495,299 | A | * | 4/1893 | Calcutt | 215/330 |
| 2,013,669 | A | * | 9/1935 | Peters | 220/296 |
| 2,264,792 | A | * | 12/1941 | Gray et al. | 215/331 |
| 3,435,978 | A | * | 4/1969 | Wittwer | 215/217 |
| 3,888,376 | A | | 6/1975 | Cooke | |
| 3,952,899 | A | | 4/1976 | Cooke | |

(Continued)

FOREIGN PATENT DOCUMENTS

| | | | |
|---|---|---|---|
| DE | 102009044896 | B3 | 5/2011 |
| EP | 0627357 | A1 | 12/1994 |
| JP | 2003221048 | A | 8/2003 |

OTHER PUBLICATIONS

Intellectual Property Office of Great Britain, Search Report of British Patent Application No. GB1108656.8, dated Sep. 20, 2011, 1 page.

(Continued)

*Primary Examiner* — Ernesto Grano
(74) *Attorney, Agent, or Firm* — McCoy Russell LLP

(57) ABSTRACT

An orientatable closure for a container comprises a body with a screw thread, the thread comprising a first portion having a first thickness and a second portion having a second thickness. The first and second thicknesses are different and the interface between the first and second portions defines a stop such that a co-operating screw thread on a container is not rotatable past the interface, whereby to define a predetermined relative orientation between the closure and container.

15 Claims, 3 Drawing Sheets

(56) References Cited

U.S. PATENT DOCUMENTS

| | | | | | |
|---|---|---|---|---|---|
| 4,084,716 | A | * | 4/1978 | Bogert | 215/217 |
| 4,387,817 | A | * | 6/1983 | Wiles et al. | 215/217 |
| 4,519,518 | A | * | 5/1985 | Wiles et al. | 215/331 |
| 4,548,331 | A | * | 10/1985 | Montgomery | 220/253 |
| 4,770,308 | A | * | 9/1988 | Lynn | 215/330 |
| 4,877,144 | A | * | 10/1989 | Thanisch | 215/330 |
| 5,184,741 | A | * | 2/1993 | Chevassus et al. | 215/331 |
| 5,690,241 | A | * | 11/1997 | Montgomery | 215/28 |
| 6,431,381 | B1 | * | 8/2002 | Randall | 215/331 |
| 7,510,094 | B1 | * | 3/2009 | Willis et al. | 215/218 |
| 2003/0168423 | A1 | * | 9/2003 | Williams | 215/204 |
| 2004/0232064 | A1 | * | 11/2004 | Wilkinson et al. | 210/435 |
| 2005/0242005 | A1 | | 11/2005 | Yurko | |

OTHER PUBLICATIONS

European Patent Office, International Search Report and Written Opinion of PCT/GB2012/000427, dated Sep. 7, 2012, 9 pages.

State Intellectual Property Office of the People's Republic of China, First Office Action Issued in Application No. 201280025174.2, dated Dec. 3, 2014, 9 pages.

European Patent Office, Office Action Issued in Application No. 12727390.2, dated Apr. 12, 2017, Netherlands, 5 pages.

* cited by examiner

CLOSURE

CROSS-REFERENCE TO RELATED APPLICATIONS

The present application is the U.S. National Phase of International PCT Application Serial No. PCT/GB2012/000427, entitled "A Closure," filed May 14, 2012, which claims priority to Great Britain Application No. 1108656.8, filed May 23, 2011, each of which are hereby incorporated by reference in their entirety for all purposes.

The present invention relates generally to a closure for a container and particularly to a closure which can be positioned in a particular orientation relative to a container.

In many cases it is desirable for a closure to be in a particular orientation with respect to a container. For example closures with hinges and/or spouts or other offset parts may need to be orientated towards the front or rear of a container.

It is known to provide orientatable closures but the components involved in the orientation are susceptible to damage if the closure is overturned, thus losing the orientation.

The present invention seeks to address the problems with known closures.

According to a first aspect of the present invention there is provided an orientatable closure for a container, comprising a body with a screw thread, the thread comprising a first portion having a first thickness and a second portion having a second thickness, the first and second thicknesses being different and an interface between the first and second portions defining a stop such that a cooperating screw thread on the container is not rotatable past the interface whereby to define a predetermined relative orientation between the closure and the container.

The thread of the closure therefore includes at least two different portions with different sections. The term thickness is intended to mean the axial extent or height relative to the body rather than the radial extent.

This means that the closure can be screwed on to a container so that the container thread can rotate up the closure thread only until it reaches the interface, at which point the container thread is not rotatable past the interface and onto the other portion of the closure thread.

The screw thread on the closure may be internal. Although internal screw threads may be most commonly used, external screw threads on a closure body are not beyond the scope of the present invention.

The screw thread may be substantially continuous. A single style thread may therefore be used, but also multi-start threads in which the first and/or second thread portions are discontinuous may be used.

The second portion may be thicker than the first portion. Therefore the first portion may define the start of the closure thread which initially receives a container neck finish thread. Thereafter the interface with the thicker second portion presents an abutment surface for the start of the container thread.

The second portion may be increased in thickness relative to the first portion away from an open end of the closure which is presented to a container. In other words, the stop is "above" the first portion when considered relative to the open end of the closure.

One surface of the portions may be continuously linear. In other words a lower surface of the portions may effectively be continuous, with the other portion extending above/below the other to create the interface.

The stop may be generally right angular. In other words the interface is not a taper between the first and second portions but rather an abrupt step change.

The closure may comprise a dispensing spout. Orientation of the dispensing spout with a container can be achieved using the thread formation pattern of the closure.

Additionally or alternatively the closure may comprise a base and a lid which may be connected to each other by a hinge.

The screw thread of a container used in conjunction with the closure may be standard.

The present invention also relates to a closure as described herein in combination with a container.

According to an alternative aspect of the present invention there is provided a container neck finish for an orientatable closure, the finish having a screw thread comprising a first portion having a first thickness and a second portion having a second thickness, the first and second thicknesses being different and the interface between the first and second portions defining a stop such that a cooperating screw thread on a closure is not rotatable past the interface whereby to define a predetermined relative orientation between the container and closure.

The present invention therefore also appreciates that the screw thread formation previously described in relation to a closure could alternatively be applied to a container neck finish.

For example, the start of a container neck finish may be thinner than a downstream, thicker portion so that a closure screw thread can be rotated onto the neck and then will abut the container neck finish screw thread interface so that it cannot rotate any further.

The present invention will now be more particularly described, by way of example, with reference to the accompanying drawings.

Figure 1:
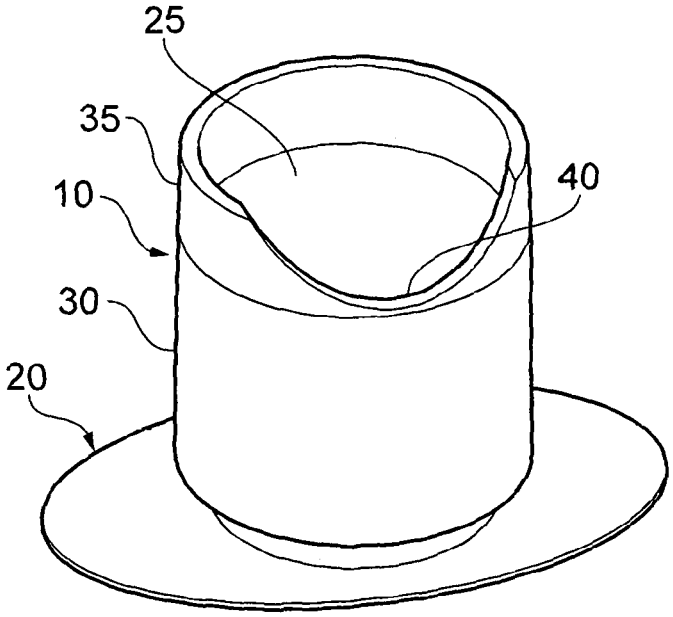
FIG. 1 is a perspective view of a closure formed according to the present invention shown fitted to a container.
Figure 2:
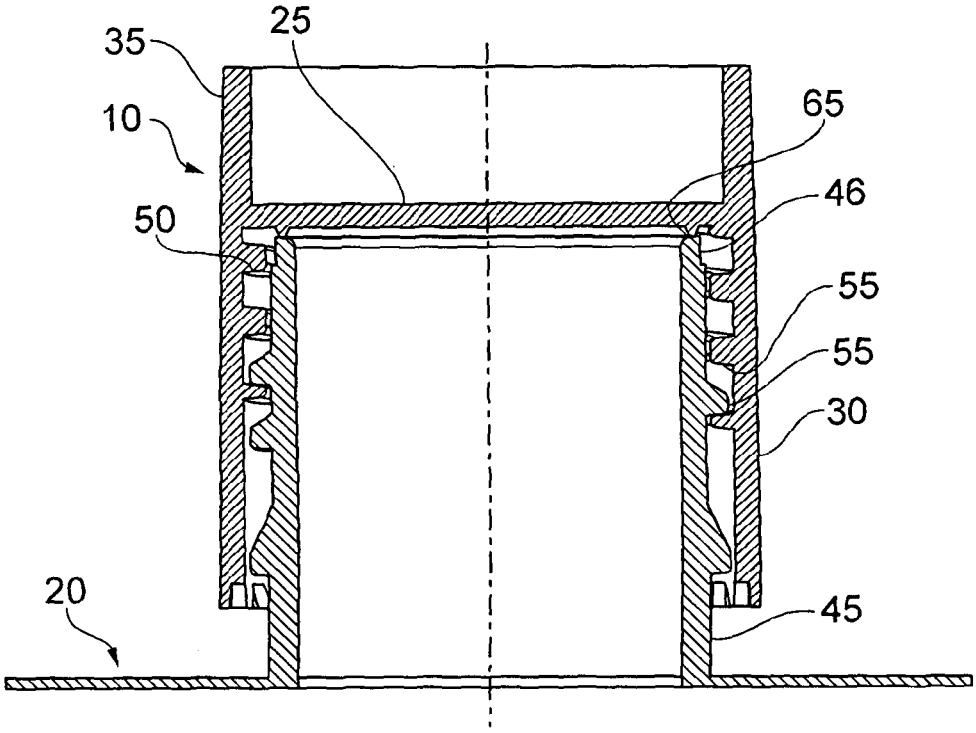
FIG. 2 is a section of the closure and container of FIG. 1.

Referring first to FIGS. 1 and 2 there is shown a closure 10 attached to a container 20.

The closure 10 comprises a generally circular top plate 25. A generally cylindrical side wall 30 depends from the periphery of the top plates 25. An annular wall 35 upstands from the periphery of the top plate 25 and is coextensive with the side wall 30.

The wall 35 includes a curved cut-out portion 40 at one point around its circumference. Because there is only one cut-out the closure 10 is not symmetrical. Accordingly, if the cut out 40 is to be positioned in a required orientation relative to the container 20 the closure 10 must be fitted onto the container 20 so that when secured it adopts the required position relative to the container 20.

The closure 10 is secured to the neck 45 of the container 20 by a screw thread arrangement. The inner face of the side wall 30 includes an internal screw thread 50 and the external surface of the neck 45 includes an external screw thread 55.

The underside of the top plate 25 includes an annular projection 65 which, when the closure is screwed on fully to the neck as shown in FIG. 2, contacts the neck rim 46. In other embodiments (not shown) different types of projections are used. For example a 'crab's claw' type seal may be used as an alternative to a static ring.

Figure 3:
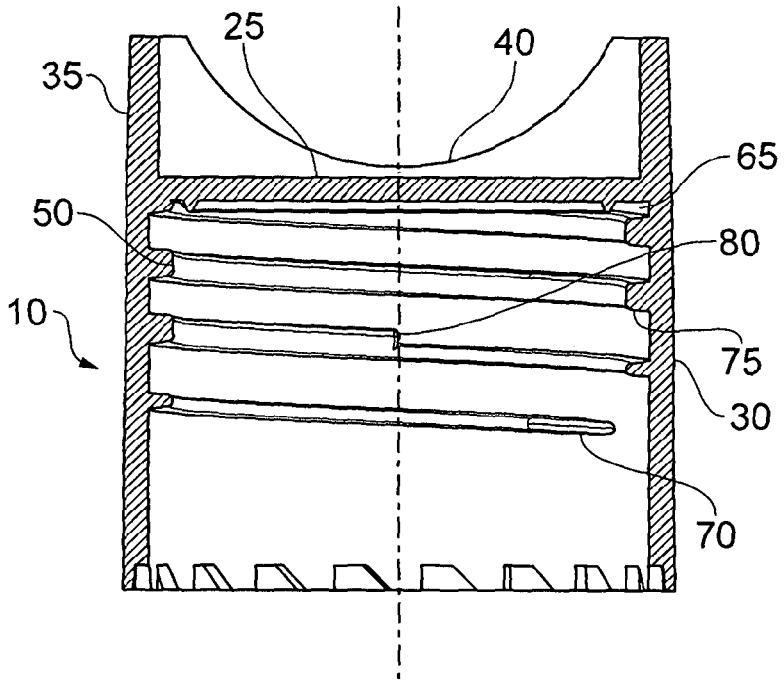
FIG. 3 is a section of the closure and container of FIG. 2.
Figure 4:
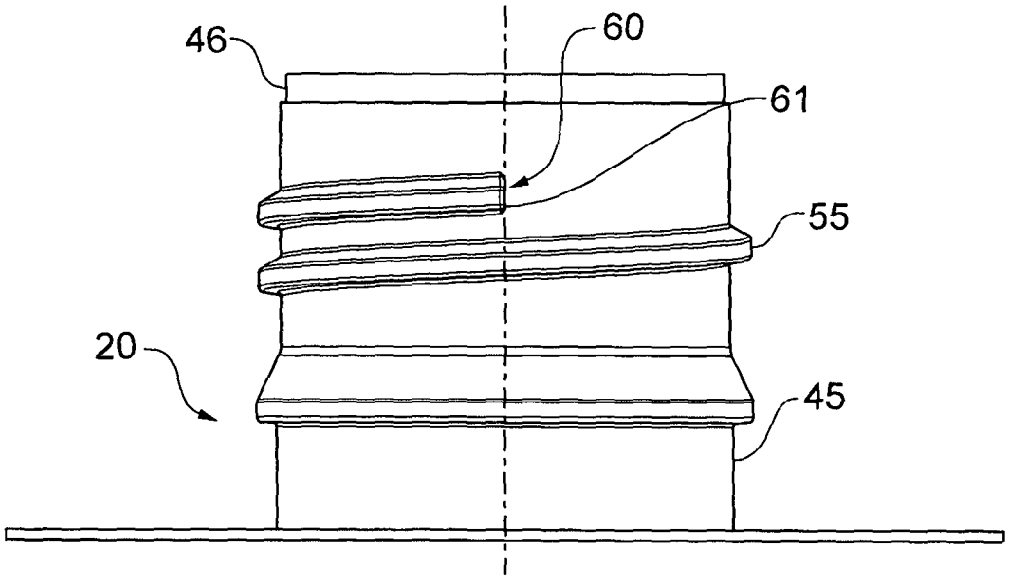
FIG. 4 is a side elevation of the container of FIGS. 1 and 2.

Referring now also to FIGS. 3 and 4 the screw threads 50, 55 are shown. The screw thread 55 on the neck 45 is generally standard and comprises a single start thread. The thread 55 has a start 60 with a generally flat face 61.

The thread 50 of the closure 10 comprises a first, thinner portion 70 and a second thicker portion 75. The portion 75 is thicker than the portion 70 in a direction towards the top plate 25 so that the lower surface of the thread 50 is continuously curved. The thread 70 provides the start of the thread 50. The interface where the portions 70, 75 meet defines a step 80 with a flat abutment face.

Figure 5:
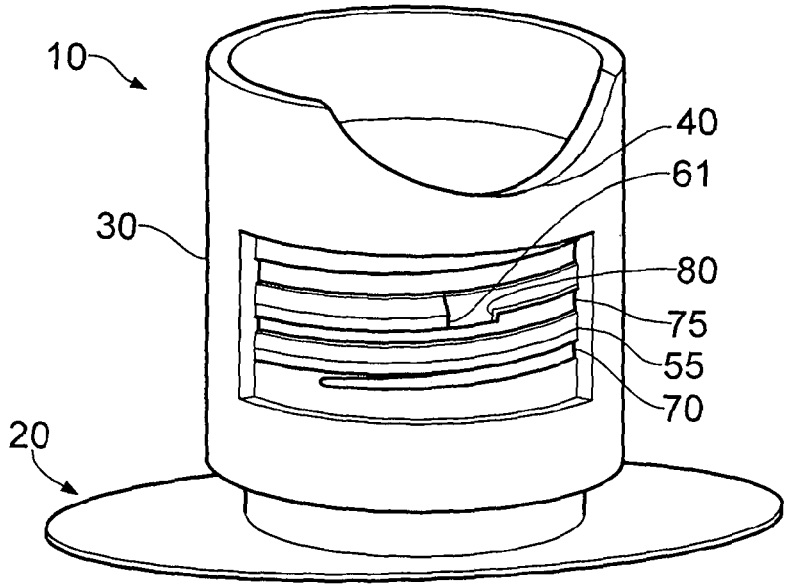
FIG. 5 is a cut-away view of the closure of FIG. 3 shown rotated onto the neck of FIG. 4 as it approaches an end stop.
Figure 6:
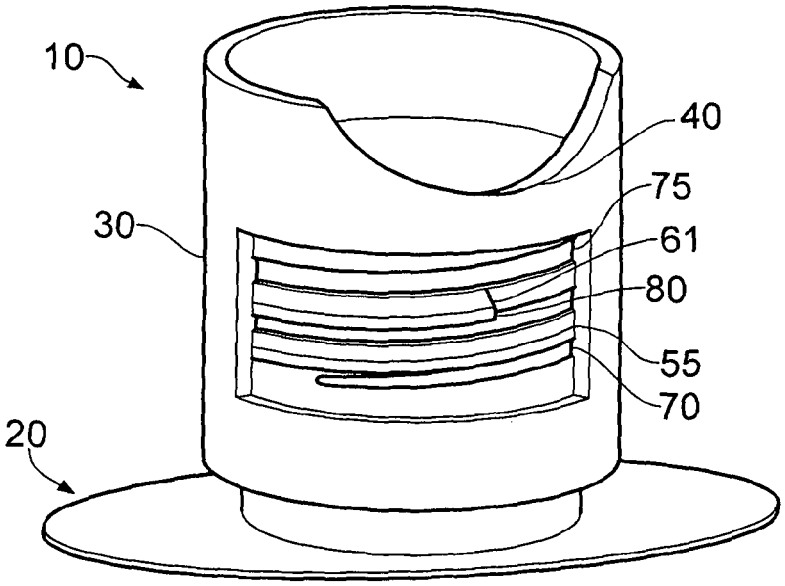
FIG. 6 is a cut-away view of the closure and container of FIG. 5 with the closure shown fully rotated onto the container neck.

In use, the closure 10 is presented to the neck 45 and screwed onto it. The thread 55 meets the thread portion 70 and moves along it. In FIG. 5 the flat face 61 of thread start 60 is shown approaching the step 80 and continued rotation causes the flat face 61 to reach and abut against the step 80 as shown in FIG. 6. The step 80 prevents further rotation of the closure 10 with respect to the neck 45 and therefore the orientation of the cut out 40 with respect to the container 20 is predetermined and set by the fully screwed-on position of the closure defined by the step 80.

The invention claimed is:

1. An orientatable closure for a container, the orientatable closure comprising a body with a continuous screw thread, the continuous screw thread comprising a first portion having a first thickness and a second portion having a second thickness, the first portion and the second portion forming different sections of the continuous screw thread, the first thickness and the second thickness being different, the first portion providing the start of the continuous screw thread of the orientatable closure, one of the first portion and the second portion extending above/below the other of the first portion and the second portion, the second portion being increased in thickness relative to the first portion and an interface between the first portion and the second portion being provided by a step in the continuous screw thread between the first thickness and the second thickness in the continuous screw thread which defines a stop, such that the orientatable closure can be screwed onto a co-operating continuous screw thread on the container by the continuous screw thread of the orientatable closure meeting the co-operating screw thread on the container and moving along the co-operating screw thread on the container until the co-operating screw thread on the container cannot be rotated beyond the stop so that when the orientatable closure is in a fully screwed on position on the container, the orientatable closure is located at a predetermined orientation with respect to the container by the stop interacting with the container.

2. The orientatable closure as claimed in claim 1, in which the continuous screw thread of the orientatable closure is internal.

3. The orientatable closure as claimed in claim 1, in which the continuous screw thread of the orientatable closure is a single start thread.

4. The orientatable closure as claimed in claim 1, in which the second portion is increased in thickness relative to the first portion away from an open end of the orientatable closure which is presented to the container.

5. The orientatable closure as claimed in claim 1, in which one surface of the first portion and the second portion is continuously linear.

6. The orientatable closure as claimed in claim 1, in which the stop is generally right angular.

7. The orientatable closure as claimed in claim 1, in which the stop comprises a flat abutment face.

8. The orientatable closure as claimed in claim 1, in which the orientatable closure comprises a dispensing spout.

9. The orientatable closure as claimed in claim 1, in which the orientatable closure comprises a base and a lid.

10. The orientatable closure as claimed in claim 1, in which a radial extent of each of the first portion and the second portion is the same at the interface.

11. The orientatable closure as claimed in claim 1, in which the continuous screw thread of the orientatable closure is included on an inner face of a side wall depending from a periphery of a top plate of the orientatable closure.

12. A neck finish of a container for an orientatable closure, the neck finish comprising a continuous screw thread, the continuous screw thread comprising a first portion having a first thickness and a second portion having a second thickness, the first portion and the second portion forming different sections of the continuous screw thread, the first thickness and the second thickness being different, the first portion providing the start of the continuous screw thread on the neck finish of the container, one of the first portion and the second portion extending above/below the other of the first portion and the second portion, the second portion being increased in thickness relative to the first portion and an interface between the first portion and the second portion being provided by a step in the continuous screw thread between the first thickness and the second thickness in the continuous screw thread which defines a stop, such that when the orientatable closure is screwed onto the neck finish of the container the continuous screw thread on the neck finish of the container meets a co-operating continuous screw thread on the orientatable closure and moves along the co-operating continuous screw thread on the orientatable closure until the co-operating continuous screw thread on the orientatable closure cannot be rotated beyond the stop so that when the orientatable closure is in a fully screwed on position on the neck finish of the container, the neck finish of the container is located at a pre-determined orientation with respect to the orientatable closure by the stop interacting with the orientatable closure.

13. In combination, a closure and a neck finish of a container, the closure comprising a closure screw thread and the neck finish comprising a neck finish screw thread, one of the neck finish screw thread and the closure screw thread being a continuous screw thread and comprising a first portion having a first thickness and a second portion having a second thickness, the first portion and the second portion forming different sections of the continuous screw thread, the first thickness and the second thickness being different, the first portion providing the start of the continuous screw thread, one of the first portion and the second portion extending above/below the other of the first portion and the second portion, the second portion being increased in thickness relative to the first portion and an interface between the first portion and the second portion being provided by a step in the continuous screw thread between the first thickness and the second thickness in the continuous screw thread which defines a stop, the other of the neck finish screw thread and the closure screw thread being a co-operating continuous, generally standard screw thread, such that the closure can be screwed onto the neck finish of the container by the continuous screw thread of one of the closure and the neck finish of the container meeting the co-operating continuous, generally standard screw thread of the other of the closure and the neck finish of the container and moving along the co-operating continuous, generally standard screw thread until the co-operating continuous, generally standard screw thread is not rotatable past the stop of the continuous screw thread so as to define a predetermined relative orientation between the closure and the neck finish of the container when the closure is fully screwed onto the neck finish of the container.

14. The combination as claimed in claim 13, in which the closure is not locked onto the container in a fully screwed on position and is freely unscrewable from the neck finish of the container.

15. The combination as claimed in claim 13, in which the co-operating continuous, generally standard screw thread has a start with a generally flat face.

* * * * *